US008267722B2

(12) United States Patent
Zhou et al.

(10) Patent No.: US 8,267,722 B2
(45) Date of Patent: Sep. 18, 2012

(54) CABLE CONNECTOR ASSEMBLY HAVING IMPROVED GROUNDING MEMBER

(75) Inventors: Yi Zhou, ShenZhen (CN); Xian-Kui Shi, ShenZhen (CN); Chung-Yen Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 443 days.

(21) Appl. No.: 12/586,152

(22) Filed: Sep. 16, 2009

(65) Prior Publication Data

US 2010/0068922 A1 Mar. 18, 2010

(30) Foreign Application Priority Data

Sep. 16, 2008 (CN) ..... 2008 2 0302129 U

(51) Int. Cl.
*H01R 13/648* (2006.01)

(52) U.S. Cl. ..... 439/607.25; 439/540.1

(58) Field of Classification Search ..... None
See application file for complete search history.

(56) References Cited

U.S. PATENT DOCUMENTS

| | | | | |
|---|---|---|---|---|
| 6,234,834 | B1 * | 5/2001 | Tsai et al. | 439/541.5 |
| 6,234,841 | B1 * | 5/2001 | Chang et al. | 439/607.25 |
| 6,456,503 | B1 * | 9/2002 | Murasawa et al. | 361/799 |
| 6,508,665 | B1 * | 1/2003 | Yeh | 439/541.5 |
| 6,835,092 | B2 * | 12/2004 | Wan et al. | 439/541.5 |
| 7,048,550 | B2 * | 5/2006 | Hyland et al. | 439/67 |
| 7,318,746 | B2 * | 1/2008 | Ezaki | 439/541.5 |
| 7,384,310 | B2 * | 6/2008 | Hu et al. | 439/607.01 |
| 7,670,173 | B2 * | 3/2010 | Hu et al. | 439/541.5 |
| 2005/0095908 | A1 * | 5/2005 | Xue et al. | 439/541.5 |
| 2006/0014431 | A1 * | 1/2006 | Shuey et al. | 439/607 |

* cited by examiner

*Primary Examiner* — Michael Zarroli
(74) *Attorney, Agent, or Firm* — Wei Te Chung; Andrew C. Cheng; Ming Chieh Chang

(57) ABSTRACT

A cable connector assembly (100), comprising a frame (1) have a plurality of passageways (13) and a plurality of openings (14) in a front wall (123) of the frame and in communication with the corresponding passageway (13); a plurality of electrical connectors (2) received in the corresponding passageways (13), each electrical connector (2) having a terminal seat (21), a shell (22) enclosing the terminal seat (21) and a mating portion (25) exposed at the corresponding opening (14); a grounding member (3) having a body portion (30), at least two first contact arms (31) and at least one second contact arm (32) formed with the body portion (30), each first contact arm (31) contacting the shell (22) of one of the electrical connectors (2), said at least one second contact arm (32) extending out the frame (1) and disposed around the front wall (123) of the housing (1).

10 Claims, 6 Drawing Sheets

CABLE CONNECTOR ASSEMBLY HAVING IMPROVED GROUNDING MEMBER

FIELD OF THE INVENTION

The present invention generally relates to a cable connector assembly, and particularly to a cable connector assembly having an improved grounding member.

DESCRIPTION OF RELATED ART

A cable connector assembly is commonly devised to electrically connect two or more electronic apparatuses, such as a mother board of a computer and a peripheral equipment. The cable connector assembly includes many electrical connectors and a number of cables electrically connected with the electrical connector respectively. The cable connector assembly comprises a number of grounding members electrically connecting with the shell of the electrical connector respectively for eliminating noise. TW Pat. No. M318832 issued to Wu Ming-Hui on Sep. 11, 2007 discloses a cable connector assembly similar to above mentioned. This cable connector assembly has a number of small grounding members electrically connecting with the shell of the electrical connector respectively, however, those small grounding members are difficult to be assembled to a housing of the cable connector assembly.

BRIEF SUMMARY OF THE INVENTION

An object of the present invention is to provide a cable connector assembly having an improved grounding member.

In order to achieve the above-mentioned object, a cable connector comprising a frame have a plurality of passageways and a plurality of openings in a front wall of the housing and in communication with the corresponding passageway. A plurality of electrical connectors received in the corresponding passageways, and each electrical connector having a terminal seat, a shell enclosing the terminal seat and a mating portion exposed at the corresponding opening. A grounding member having a body portion, at least two first contact arms and at least one second contact arm formed with the body portion, and each first contact arm contacting the shell of one of the electrical connectors, said at least one second contact arm extending out the frame and disposed around the front wall of the housing.

The foregoing has outlined rather broadly the features and technical advantages of the present invention in order that the detailed description of the invention that following may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
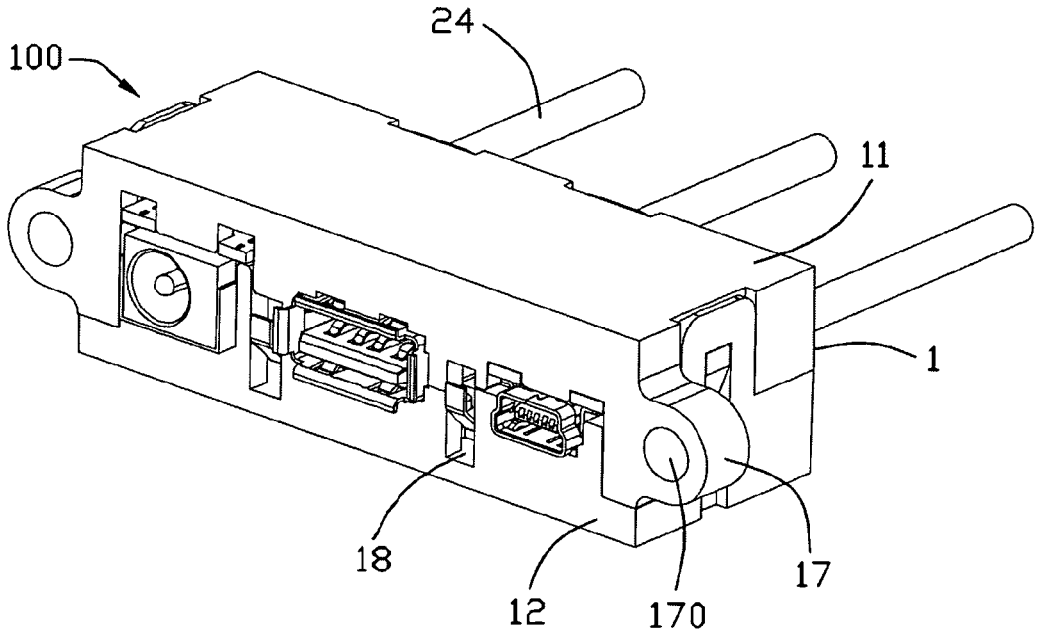
FIG. 1 is a perspective view of a cable connector assembly in accordance with the present invention.
Figure 2:
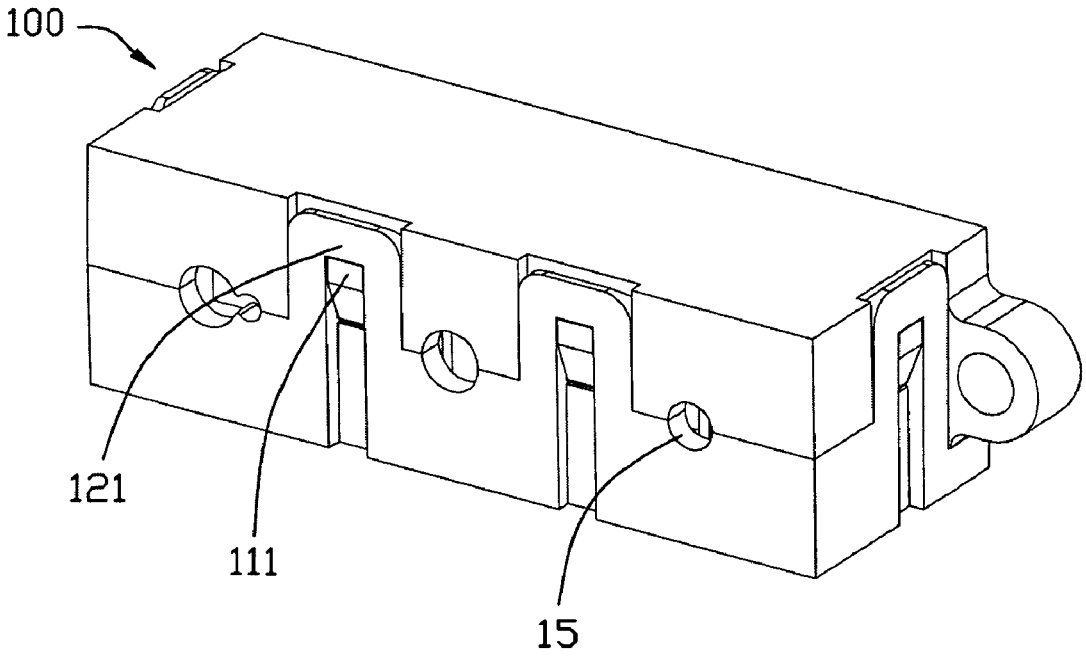
FIG. 2 is a view similar to FIG. 1, but viewed from a different aspect.
Figure 3:
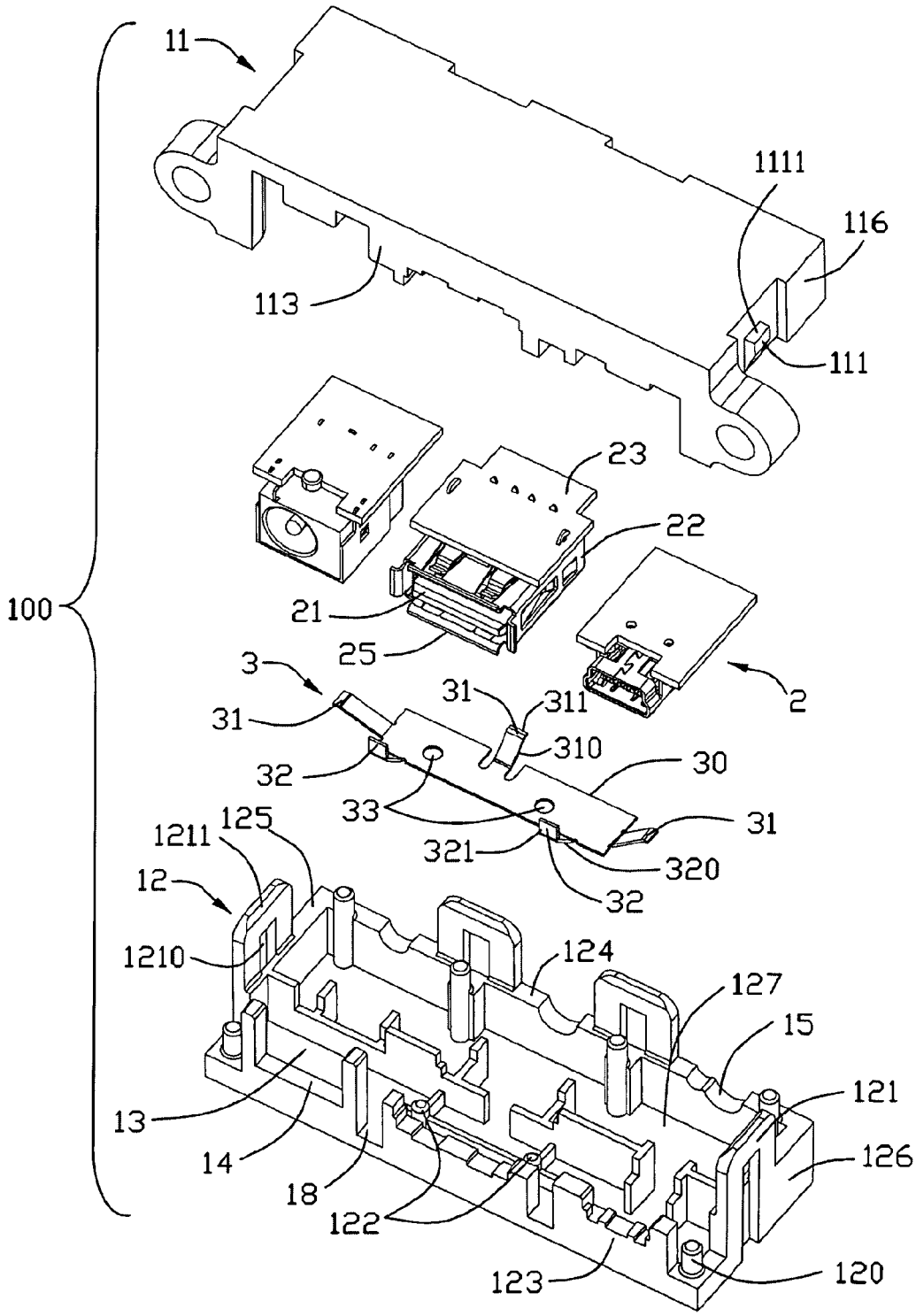
FIG. 3 is an exploded, perspective view of a cable connector assembly in accordance with the present invention.
Figure 4:
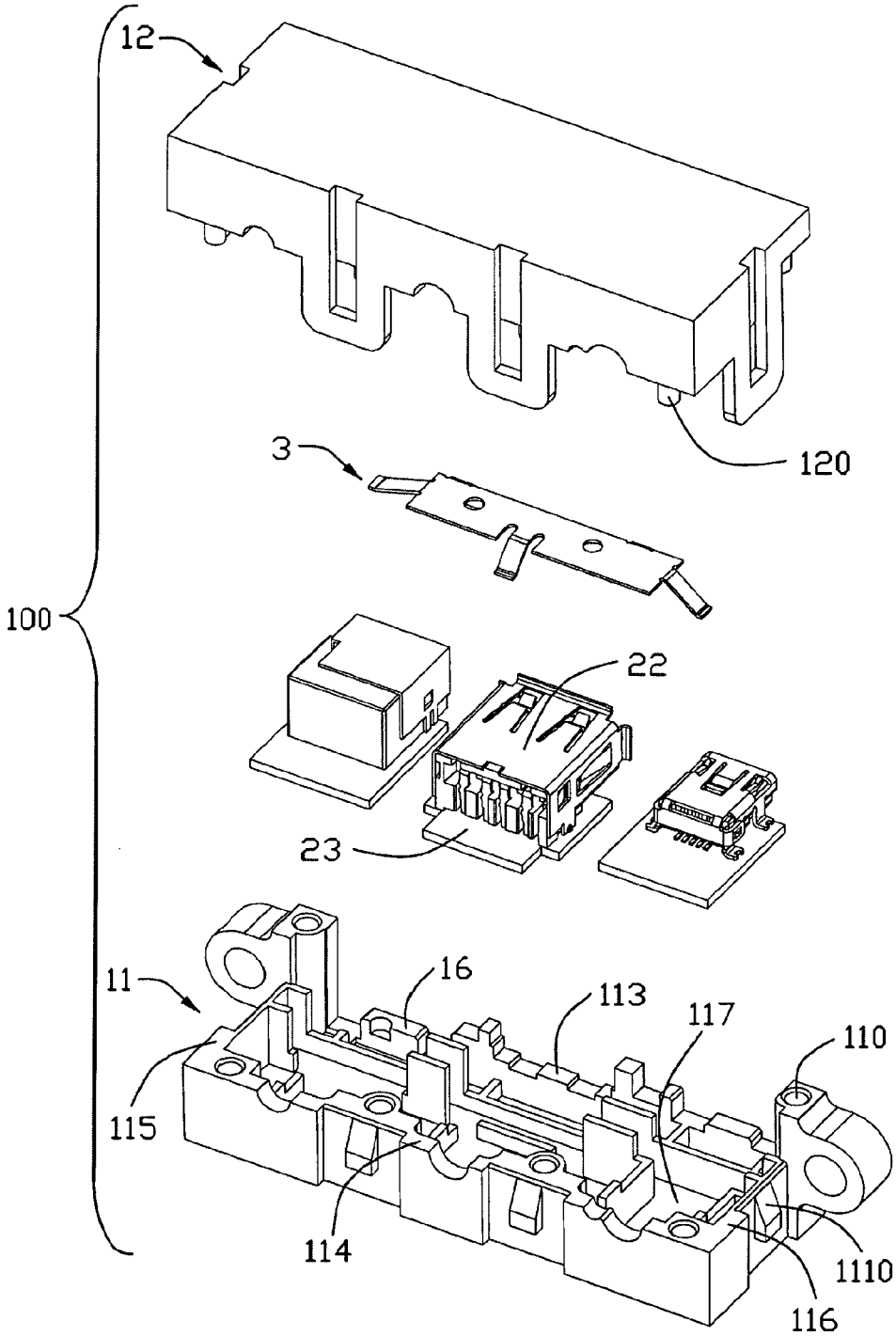
FIG. 4 is a view similar to FIG. 3, but viewed from a different aspect.

Referring to FIGS. 1-4, a cable connector assembly 100 comprises an insulative housing 1, a plurality of electrical connectors 2 and a grounding member 3.

The insulative housing 1 includes an upper cover 11 and a lower cover 12. The insulative housing 1 has three passageways 13 and three openings 14 in communication with the passageways 13 respectively, and there are three through holes 15 in communication with the passageways 13 respectively. The upper cover 11 and lower cover 12 defines a plurality of holes 110 on the front wall 113, back wall 114 of the upper cover 11 and a plurality of post 120 on the front wall 123, back wall 124 of the lower cover 12. The lower cover 12 have four lockers 121 on the side wall 126 and the back wall 124 of the lower cover 12, the lower cover 12 has a through hole 1210 and a lead portion 1211 proximate the through hole 1210. The upper cover 11 have four tubers 111 on the side walls 115,116 and the back wall 114 of the upper cover 11 for locking with the locker 121 respectively, the tuber 111 has a slanted lead face 1110 and a locking face 1111 parallel with the bottom wall 117. The side wall 115 and 116 of the upper cover 11 respectively has an ear portion 17 which defines a through hole 170. Therein, the opening 14 has a block 16. The lower cover 12 have a pair of posts 122 extruded upwardly from the bottom wall 127. The insulative housing 1 have two openings 18 which communication with the passageway 13 and arranged between two openings 14 respectively.

Referring to FIGS. 1-4, the electrical connectors 2 are received in the passageway 13 of the insulative housing 1 respectively, each electrical connector 2 comprises a terminal seat 21, a shell 22, a print circuit board 23 and a wire 24 electrically connected with the print circuit board 23 and extended out from the through hole 15, the electrical connector 2 has a mating portion 25 exposed at the opening 14 of the insulative housing 1. The electrical connector 2 comprise a DC power jack connector, a universal serial bus connector and an audio jack connector.

The grounding member 3 comprises a body portion 30, three first contact arms 31 and two second contact arms 32, the body portion 30 have two holes 33 cooperate with the post 122 for fixing the grounding member 3 on the lower cover 12. The first contact arms 31 aslant extend from the back portion and side portions of the body portion 30. Each first contact arm comprises an inclined portion 310 and a contact portion 311 extended from the inclined portion 310 and parallel with the body portion 30. The second contact arm 32 aslant extended from the front portion of the body potion 30. Each second contact arm comprises an inclined portion 320 and a contact portion 321 extended from the inclined portion 320 and extends out of the insulative housing 1 from the opening 18. The first contact arm 31 and second contact arm 32 has flexibility.

Figure 5:
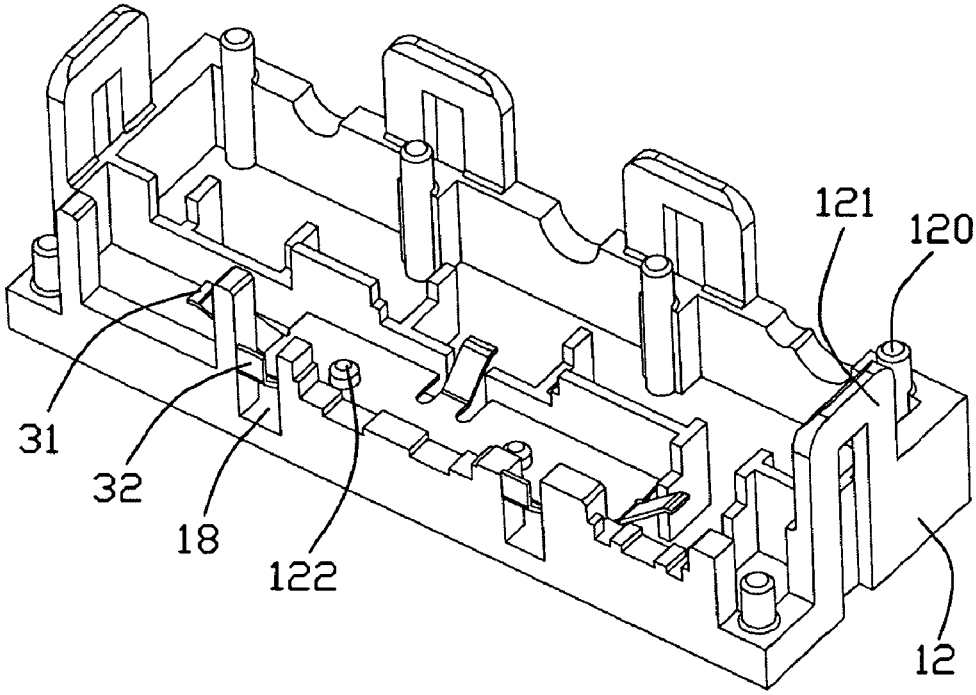
FIG. 5 is shows a grounding member mounted to a lower cover of the present invention.
Figure 6:
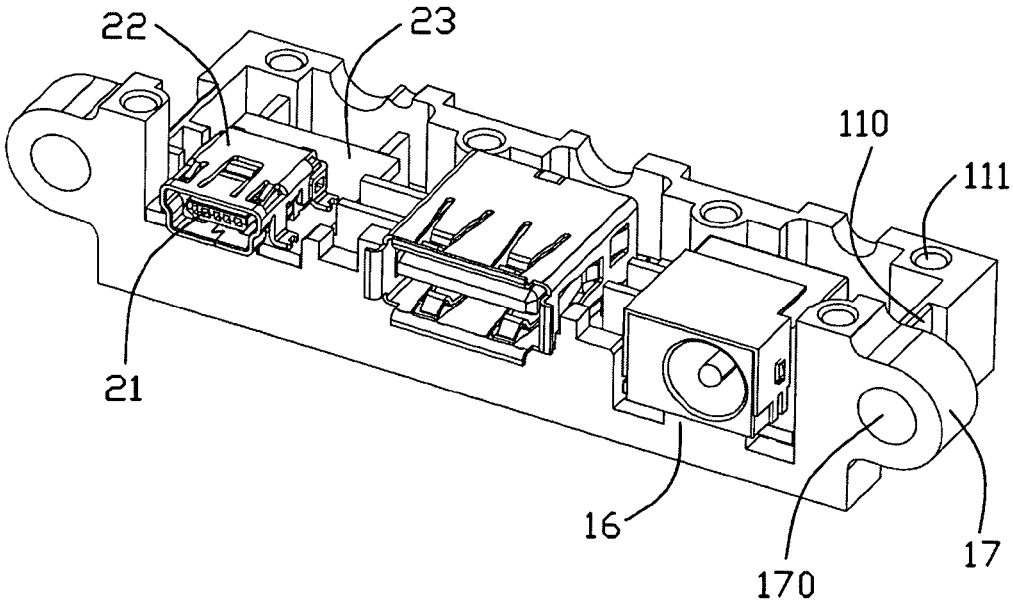
FIG. 6 is a partially assembled view of the cable connector assembly.

Please refer to FIGS. 1-6, when assembling the cable connector assembly 100, mounting the grounding member 3 to the lower cover 12, then assembling the electrical connector 2 to the corresponding passageway 13, with the wire 24 extending out from the corresponding through hole 15. Each first contact arm 31 resiliently contacts corresponding shell 22 of the electrical connector 2, each second contact arm 32 extends out of the insulative housing 1 from the corresponding opening 18, then assemble the upper cover 11 to the lower cover 12.

The other end of the wire 24 electrical connect with the corresponding electrical connector of the mother board. The through hole 170 can allow a bolt pass for fixing the cable connector assembly 100 on the PC case, the second contact arms 32 flexible contact the panel of the PC case for grounding. The mating connector can mating with the electrical connector 2 via the mating portion 25. The shell 22, grounding member 3 and the PC case connected each other for increasing the grounding area to attain a good anti-electro magnetic interference effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a frame having a plurality of passageways and a plurality of openings in a front wall of the frame and in communication with the corresponding passageway, and the frame having an upper cover and a lower cover;

a plurality of electrical connectors received in the corresponding passageways, each electrical connector having a terminal seat, a shell enclosing the terminal seat and a mating portion exposed at the corresponding opening;

a grounding member having a body portion, at least two first contact arms and at least one second contact arm formed with the body portion, each first contact arm contacting the shell of one of the electrical connectors, said at least one second contact arm extending out the frame and disposed around the front wall of the frame, the lower cover having two posts, the grounding member has two holes cooperate with the posts for fixing the grounding member to the lower cover.

2. The cable connector assembly as claimed in claim 1, wherein the cable connector has three electrical connectors, the grounding member has three first contact arms, each first contact arm contacts the shell of one of the electrical connectors.

3. The cable connector assembly as claimed in claim 2, wherein the grounding member has two second contact arms, each second contact arm extends out of the frame between two adjacent mating portions of two adjacent and separate electrical connectors.

4. The cable connector assembly as claimed in claim 1, wherein the frame has two slots in the front wall for the second contact arms extending out.

5. The cable connector assembly as claimed in claim 4, wherein each slot locate between two adjacent opening.

6. The cable connector assembly as claimed in claim 3, wherein the first contact arm comprises an inclined portion and a contact portion extended from the inclined portion, the inclined portion of the first contact arm parallel to the body portion.

7. The cable connector assembly as claimed in claim 6, wherein the second contact arm comprises an inclined portion and a contact portion extending from the inclined portion, the inclined portion of the second contact arm parallel to the front wall of the insulative housing.

8. A cable connector assembly, comprising:

a frame have a plurality of passageways and a plurality of openings in a front wall of the frame and in communication with the corresponding passageway;

a plurality of electrical connectors received in the corresponding passageways, each electrical connector having a terminal seat, a shell enclosing the terminal seat and a mating portion exposed at the corresponding opening;

a grounding member having a body portion, at least two first contact arms and at least one second contact arm formed with the body portion, each first contact arm contacting the shell of one of the electrical connectors, said at least one second contact arm extending out the frame and disposed around the front wall of the frame; wherein the cable connector has three electrical connectors, the grounding member has three first contact arms, each first contact arm contacts the shell of one of the electrical connectors; wherein the grounding member has two second contact arms, each second contact arm extends out of the frame between two adjacent mating portions of two adjacent and separate electrical connectors.

9. The cable connector assembly as claimed in claim 8, wherein the first contact arm comprises an inclined portion and a contact portion extended from the inclined portion, the inclined portion of the first contact arm parallel to the body portion.

10. The cable connector assembly as claimed in claim 9, wherein the second contact arm comprises an inclined portion and a contact portion extending from the inclined portion, the inclined portion of the second contact arm parallel to the front wall of the insulative housing.

* * * * *